US005476739A

United States Patent [19]

Takama et al.

[11] Patent Number: 5,476,739

[45] Date of Patent: Dec. 19, 1995

[54] FIXING SOLUTION CONTAINING MONOESTER OF BIVALENT ORGANIC ACID AND FIXING METHOD OF TONER IMAGES THEREWITH

[75] Inventors: Yasuko Takama, Toyonaka; Susumu Tanaka, Aichi; Kaoru Furusawa, Toyonaka, all of Japan

[73] Assignee: Minolta Camera Kabushiki Kaisha, Osaka, Japan

[21] Appl. No.: 266,015

[22] Filed: Jun. 27, 1994

[30] Foreign Application Priority Data

Jun. 28, 1993 [JP] Japan ..... 5-156639
Mar. 8, 1994 [JP] Japan ..... 6-037061

[51] Int. Cl.[6] ..... G03G 13/01; G03G 13/20

[52] U.S. Cl. ..... 430/42; 430/124

[58] Field of Search ..... 430/42, 124

[56] References Cited

U.S. PATENT DOCUMENTS 2,995,464 8/1961 Gundrach ..... 430/124
3,740,249 6/1973 Takiguchi ..... 430/124
4,311,723 1/1982 Mugrauer ..... 430/124 X
5,333,042 7/1994 Brennan et al. ..... 430/124 X

FOREIGN PATENT DOCUMENTS 46998 11/1981 Japan ..... 430/124
63-2089 1/1988 Japan .
5-27474 2/1993 Japan .
357549 10/1972 U.S.S.R. ..... 430/124

*Primary Examiner*—Roland Martin
*Attorney, Agent, or Firm*—Willian Brinks Hofer Gilson & Lione

[57] ABSTRACT

The present invention relates to a method for fixing images formed by a printing material containing a resin component on a recording medium, comprising:

a first step of providing the printing material to the recording medium to form the images, and a second step of contacting the printing material provided on the recording medium with a fixing solution to fix the printing material on the recording medium, the fixing solution comprising a monoester of bivalent organic acid.

15 Claims, 1 Drawing Sheet

FIXING SOLUTION CONTAINING MONOESTER OF BIVALENT ORGANIC ACID AND FIXING METHOD OF TONER IMAGES THEREWITH

BACKGROUND OF THE INVENTION

1. Field of the Invention

The present invention relates to a new fixing method of toner images, in which a printing material composed of a resin can be fixed strongly on a recording medium, such as paper, cloth, fiber and bonded fabric, by use of a fixing solution.

2. Description of the Prior Art

Recently a process for electrophotography has been applied increasingly and widely to various fields and paid attention to as a recording method onto not only plain paper, which is a conventional recording medium, but also fiber, cloth and other recording medium. For example Japanese Patent Laid-Open Hei 5-27474 discloses that images are recorded on natural fiber or synthetic fiber, such as cotton, wool, flax, silk and rayon, with polyamide particles by an electrophotographic process of electrostatic type. In general toner is stuck to a recording medium and fixed by heat and pressure in an electrophotographic process. In the above Japanese Patent Laid-Open Hei 5-27474, toner is also fixed on a recording medium by heat in combination with pressure.

However the above mentioned cloth has rough surface when compared to conventional paper. Therefore mere application of heat and pressure onto the surface can not achieve satisfactory fixation. Even in the case of a conventional recording medium, such as paper, a resin component of toner is fixed on only an outer surface portion of pulp fibers of paper when fixed by heat and pressure. The resin component can not reach deeply from the other surface of the pulp fibers, resulting in separation of toner from paper after fixation. Such a disadvantage is remarkable when full-color toner composed of a resin component of low molecular weight is used to form solid full-color copy images in order to give the images light-transmittance.

Moreover some clothes are weak in heat and pressure compared with conventional plain paper used as a recording medium in an electrophotographic process. An direct application of fixing techniques by heat and pressure to cloth causes change of color and curl of cloth.

SUMMARY OF THE INVENTION

The object of the present invention is to provide a new method for fixing a printing material strongly on a recording member, such as a cloth, the surface of which is irregular and paper having a network of fibers inside.

Another object of the present invention is to provide a method for fixing a printing material on a recording medium weak in heat and pressure without injuring the recording medium.

Another object of the present invention is to provide a fixing method which consumes a little energy.

Another object of the present invention is provide a fixing solution for the fixing method The present invention provides to a method for fixing images formed by a printing material containing a resin component on a recording medium, comprising:

a first step of providing the printing material to the recording medium to form the images, and a second step of contacting the printing material provided on the recording medium with a fixing solution to fix the printing material on the recording medium, the fixing solution comprising a monoester of bivalent organic acid.

DETAILED DESCRIPTION OF THE INVENTION

Figure 1:
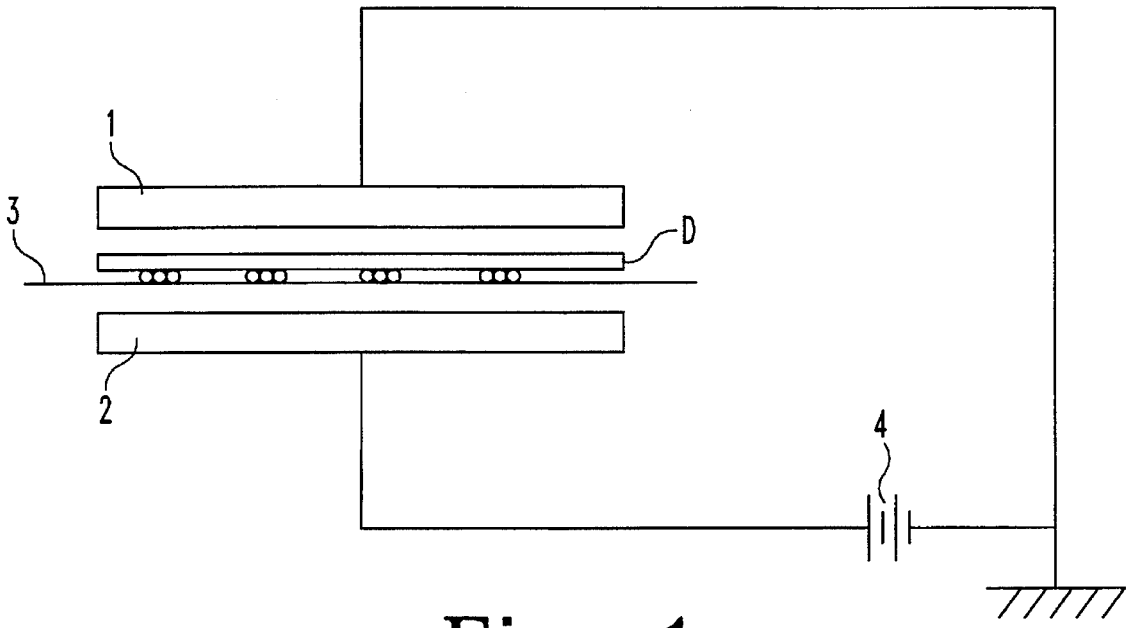
FIG. 1 is a schematic view of an apparatus for transferring toner images onto a recording member.

The present invention relates to a method for fixing images formed by a printing material containing a resin component on a recording medium, comprising:

a first step of providing the printing material to the recording medium to form the images, and a second step of contacting the printing material provided on the recording medium with a fixing solution to fix the printing material on the recording medium, the fixing solution comprising a monoester of bivalent organic acid.

In the first step of the present invention, images are formed on a recording medium with a printing material composed of a resin component. For example, images of a printing material formed on an image-supporting member, such as a photosensitive member, an electrostatic recording member and a magnetic latent image supporting member, may be transferred onto a recording medium by electrostatic force, pressure or heat to form the images of the printing material. Images of a printing material formed on an image-supporting member may be once transferred electrostatically to, for example, plain paper and then further transferred electrostatically from the paper to a recording member to form the images of the printing material. Latent images may be formed on a recording member to be developed by a printing material. Images of a printing material may be directly formed on a recording member by, for example, a ink-jetting method. Heat and/or pressure may be applied to a recording medium on the surface of which images of a printing material are formed in order to heighten adherence of the printing material to the recording medium. Other methods may be used insofar as images of a printing material containing a resin component can be formed on a recording medium.

It is preferable in the first step that a printing material is supported electrostatically to a recording medium. In more particularly, when a printing material, such as toner, formed on an image-supporting member, such as a photosensitive member, is transferred electrostatically to a recording medium, such as paper and cloth, by means of a corona charger or an electrostatically transferring roller, the printing material can be transferred without disorder of images.

In the second step of the present invention, images of a printing material formed on a recording medium in the first step are brought into contact with a fixing solution containing a monoester of bivalent organic acid. The printing material is swelled or dissolved to be fixed on the recording medium.

In this second process, as the printing material is swelled or dissolved, a printing material can be fixed strongly even on irregular surface of recording medium such as bonded fabric, and other media such as paper and knitted goods which have a network structure and on which a printing material can not be fixed before. The printing material reaches deeply inside the recording medium and is fixed, resulting in strong fixing properties.

Heat and pressure are not necessarily essential in the present invention. Therefore a fixing method of the present invention is an energy-saving method, even though a heating and/or pressing process is used in combination because a little heat and a low pressure is applied in the present invention compared with a conventional method. Moreover a recording medium is not injured because a heat and/or a pressure is not applied thereon more than necessary. Therefore a recording medium weak in heat and pressure, such as silk, rayon and Kevlar, may be used in the present invention.

The fixing solution used in the present invention may be exemplified by the one containing at least a monoester of bivalent organic acid, which is particularly effective for a toner or a printing material containing a resin component as a fixing component and used in an electrophotographic method widely known as an image-recording method. Other solvent may be used insofar as a dye component, such as a charge controlling agent, and a coloring material, such as a pigment, contained in toner do not be dissolved but a resin component is mainly swelled or dissolved to fix the toner inside a recording medium.

The bivalent organic acid, which is one component of the monoester of bivalent organic acid, may be exemplified by saturated or unsaturated aliphatic acids, such as oxalic acid, malonic acid, succinic acid, glutaric acid, adipic acid, pimelic acid, suberic acid, azelaic acid, sebacic acid, maleic acid and fumaric acid, and aromatic carboxylic acids, such as phthalic acid, isophthalic acid and terephthalic acid. Among those acids, the saturated aliphatic acids, such as oxalic acid, malonic acid, succinic acid, glutaric acid, adipic acid, pimelic acid, suberic acid, azelaic acid and sebacic acid are preferable.

The alcohol, which is the other component of the monoester of bivalent organic acid, may be exemplified by univalent alcohols (which may be straight or branched), such as methanol, ethanol, propanol, butanol and pentanol, polyvalent alcohols, such as ethylene glycol, glycerin, pentaerythritol and sorbitol, glycols, such as diethylene glycol, dipropylene glycol and polyethylene glycol, and Cellosolves, such as ethyl Cellosolve and butyl Cellosolve. The alcohol may be used singly or in combination with other alcohols.

The monoester of bivalent organic acid may be prepared by esterification reaction of the bivalent organic acid with the alcohol, or hydrolysis reaction of a diester of the bivalent organic acid.

Preferable monoesters of bivalent organic acid may be represented by the following formula:

$$HOOC—(CH_2)_n—COOR_1$$

in which $R_1$ represents an alkyl group having 1 to 5 carbon atoms and the letter "n" represents an integer of 0 to 8.

The monoester of bivalent organic acid represented by the above formula is particularly exemplified by:
monoester of oxalic acid ($HOOC—COOR_1$),
monoester of malonic acid ($HOOC—CH_2—COOR_1$),
monoester of succinic acid ($HOOC—(CH_2)_2—COOR_1$),
monoester of glutaric acid ($HOOC—(CH_2)_3—COOR_1$),
monoester of adipic acid ($HOOC—(CH_2)_4—COOR_1$),
monoester of pimelic acid ($HOOC—(CH_2)_5—COOR_1$),
monoester of suberic acid ($HOOC—(CH_2)_6—COOR_1$),
monoester of azelaic acid ($HOOC—(CH_2)_7—COOR_1$),
monoester of sebacic acid ($HOOC—(CH_2)_8—COOR_1$) and a mixture thereof.

Among those monoesters, the one in which $R_1$ is methyl, ethyl or propyl is preferable from the viewpoint of water solubility. The monoester of bivalent organic acid may be used singly or in combination with other monoesters.

The monoester of bivalent organic acid is desirably contained in the fixing solution at an amount of 5% by weight or more, preferably 5–60% by weight, more preferably 20–40% by weight relative to the total amount of the fixing solution.

The fixing solution used in the present invention may be further added with a surface active agent. The surface active agent effects to improve fixing properties particularly in the case of paper and cloth as a recording medium. The improvement of fixing properties may be caused by penetration of a fixing solution into a network structure of the recording member, such as paper, by action of the surface active agent The surface active agent useful in the present invention may be exemplified by an anionic surface active agent, a nonionic surface active agent, a cationic surface active agent, an amphoteric surface active agent and a mixture thereof.

The anionic surface agent may be exemplified by fatty acid esters, alkyl sulfuric esters, alkyl benzene sulfonates, alkyl naphthalene sulfonates, alkyl sulfosuccinates, alkyl diphenyl ether disulfonates, and formalin condensates of naphthalene sulfonates and polymeric surfactant of polycarboxylic acids.

The nonionic surface agent may be exemplified by polyoxyethylene alkyl ethers, polyoxyethylene alkyl aryl ethers, copolymers of oxyethylene-oxypropylene, sorbitan fatty acid esters, polyoxyethylene-sorbitan fatty acid esters and polyoxyethylene alkyl amines.

The cationic surface agent and the amphoteric surface active agent are exemplified by alkyl amine salts, quaternary ammonium salts, alkyl betaines and amine oxides.

The above surface active agent may be used singly or in combination with each other. A particularly preferable surface active agent is a nonionic surface active agent of polyoxyethylene type represented by following formula:

$$RO(CH_2CH_2O)_nH$$

in which R represents an alkyl group or an alkylphenyl group; the letter 'n' presents an integer of 1 to 10.

A content of the surface active agent is within the range between 0.1 and 10% by weight, preferably between 1 and 3% by weight relative to the total amount of fixing solution when the surface active agent is added. If the content is less than 0.1% by weight, the effects caused by addition of the surface active agent can not be achieved. If the content is more than 10% by weight, it is difficult to handle it because of bubbles.

When paper is used as a recording medium in the present invention, it is preferable that water is added to the fixing solution of the present invention. The paper has a structure with pulp fibers hydrogen-bonded each other. Water works to make the fibers more separately. Therefore toner can reach deeply inside the paper to be fixed.

When water is added, a content of water is within the range between 1 and 90% by weight, preferably between 20 and 80% by weight relative to the total amount of fixing solution. Water is used too much, binding power between paper fibers is overweakened, and a network structure of the fibers is broken. If the content is less than 1% by weight, a distance between fibers of paper can not be widened enough for water to penetrate deeply inside paper.

An organic acid may be added to the fixing solution of the present invention. The organic acid effects to improve penetration of the fixing solution into a resin component of toner.

The organic acids useful in the present invention may be exemplified by saturated aliphatic acids, such as formic acid, acetic acid, propionic acid, butyric acid, valeric acid, pivalic acid, caproic acid, caprylic acid, capric acid, lauric acid, myristic acid, palmitic acid and stearic acid, unsaturated aliphatic acids, such as acrylic acid, propionic acid, mothacrylic acid, crotonic acid, oleic acid, linolic acid, erucic acid, ricinolic acid, abietic acid and resin acid, aromatic carboxylic acids, such as benzoic acid, toluic acid, naphthoic acid, cinnamic acid, 2-furic acid, nicotinic acid and isonicotinic acid. The organic acid may be used singly and in combination with other organic acids.

Further the fixing solution of the present invention may contain an organic solvent which can swell toner, such as methanol, ethanol, n-butanol, isopropanol, ethoxyethanol and a mixture thereof with xylelne, toluene, acetone, THF, dioxane and dichloromethane insofar as the effects of the invention are not ruined.

Preferable fixing solution in the present invention comprises a monoester of bivalent organic acid, a surface active agent and water. When such a fixing solution is applied to a conventional resin for toner, such as styrene-acrylic copolymer resins or polyester resins, remarkable fixing-properties can be given. Tosclean D®(made by Nagase Sangyo K.K.) is exemplified as the above fixing solution. Tosclean D is a pale yellow transparent liquid and one of an aqueous detergent, having an acid value of about 2.1 mgKOH, a specific gravity of 1.020 (20° C.) and pH of 7±0.5 (15° C.). This fixing solution does not contain fluorine- or chlorine-containing hydrocarbon which is indicated to destroy an ozone layer. Moreover it is incombustible (having no flash point), it is suitable for a fixing apparatus used in an office.

The fixing solution of the present invention may be applied to a conventional toner used as a printing material. That is, at least a colorant and a binding resin component are contained, and a charge controlling agent, a fluidizing agent and an off-set prevention agent may be contained, if necessary.

For example, as the colorant, acidic or basic dyes, metal-complex dyes, acidic or basic mordant dyes, white pigment, such as titanium white and zinc white, and black pigments, such as aniline black and carbon black may be used.

As the binding resin, not only a styrene-acrylic resin and polyester resins which are above mentioned, but also styrene-butadiene copolymer resins, epoxy resins and polyamides resins may be used.

These binding resins have preferably a molecular weight (Mn) of 3000 to 20000 and a distribution of polymerization degree (Mw/Mn) of 2 to 60 and a glass transition point (Tg) of 55° to 70° C.

The charge controlling agent added when necessary may be exemplified by positively chargeable agents, such as quaternary ammonium salts, nigrosine dyes, imidazoles and nitrogen-containing resins, and negatively chargeable agents, such as metal complex dyes, Carix allene compounds.

The fluidization agents added when necessary may be exemplified by inorganic oxide particles, such as silica, titanium oxide and aluminum oxide, and organic synthetic particles, such as Teflon, polystyrenes, acrylic polymers and styrene-acrylic copolymers.

The off-set prevention agents added when necessary may be exemplified by carnauba wax, candelilla wax, low molecular weight polyethylene wax, low molecular weight polypropylene wax of oxidized type, higher fatty acid wax, higher fatty ester wax and a mixture thereof. The off-set prevention agent is desirably added at an amount of 1 to 15 parts by weight, preferably 2 to 8 parts by weight on the basis of 100 parts by weight of a resin contained in toner.

The toner is prepared so that an average volume particle size will be within the range between 2 and 15 μm, preferably 3 and 10 μm from the view point of a balance between image quality and handling.

The toner preparation method is not limited but may be exemplified by a pulverization method in which kneaded resin is pulverized and classified, a polymerization method, such as an emulsion polymerization and a suspension polymerization, or a granulation method in which a synthesized polymer is dissolved and the solution is dried under droplet conditions.

The present invention is exemplified by specific examples with no significance in restricting the scope of the invention.

EXAMPLE 1

Clothes A, B and C (in which cloth A is made of cotton, cloth B is made of polyester and cloth C is made of Kevlar®) were used as a recording medium. Each cloth was affixed to a cardboard (made of plain paper). The cloth was affixed in two ways; three sides of the cloth were stuck to the board with a double-coated tape or with a spray paste (trade name: 55 Spray, made by 3M K.K.) sprayed on the board. Toner images were formed on the cloth affixed to the cardboard by a full-color copying machine (CF80: made by Minolta Camera K.K.).

In the above full-color copying process, electrostatic latent images are formed on a photosensitive member charged negatively in the dark by a laser beam. The electrostatic latent images are developed by negatively chargeable yellow toner. Then the toner is transferred electrically onto a recording medium (cloth) on the cardboard chucked on an intermediate transferring member by charging positively the backside of the intermediate transferring member. Cyan toner, magenta toner and black toner are developed similarly as above mentioned to be transferred electrically onto the recording medium on the cardboard. Full-color toner images are electrostatically supported to the recording medium. Then the recording medium on the cardboard is passed through a pair of pressure rollers heated by a heater in a fixing unit to make the adherence stronger.

The toner used in this example had the following composition.

| | |
|---|---|
| (yellow toner) | |
| amino-modified polyester resin (Tg:61.8° C.) | 100 pbw |
| charge controlling agent (zinc complex) | 3 pbw |
| benzidine-series compound | 4 pbw |
| (cyan toner) | |
| amino-modified polyester resin (Tg:61.8° C.) | 100 pbw |
| charge controlling agent (zinc complex) | 4 pbw |
| copper phthalocyanine compound | 4 pbw |
| (magenta toner) | |
| amino-modified polyester resin (Tg:61.8° C.) | 100 pbw |
| charge controlling agent (zinc complex) | 3 pbw |
| azo series compound | 4 pbw |

-continued

| | |
|---|---|
| (black toner) | |
| amino-modified polyester resin (Tg:61.8° C.) | 100 pbw |
| charge controlling agent (zinc complex) | 4 pbw |
| mixture of benzidine- series compound, copper phthalocyanine compound and azo series compound | 8 pbw |
| (fluidizing agent) | |
| mixture of silica and titania (fluidizing agent) | 1 pbw |
| Then adherence of toner to the recording medium was made stronger under the following conditions: | |
| temperature of heat roller: | 150° C. |
| pressure of rollers: | 2.5 Kgf/cm$^2$ |

Then adherence of toner to the recording medium was made stronger under the following conditions:
temperature of heat roller: 150° C.
pressure of rollers: 2.5 Kgf/cm$^2$ Successively the cloth with toner images adhered thereto was brought into contact with a fixing solution (Tosclean D®, made by Nagase Sangyo K.K.). Tosclean D works to swell the toner and is composed of about 26 wt % of a mixture of methyl monoester of succinic acid, methyl monoester of glutamic acid and methyl monoester of adipic acid as a monoester of bivalent organic acid, about 3 wt % of a surface active agent of polyoxyethylene type, about 8 wt % of a mixture of oleic acid, palmitic acid and linolic acid as an organic acid, and about 60 wt % of water.

The cloth was contacted with the fixing agent in the following two ways:

(1) the cloth was set horizontally on a plate with the face of toner images upwards and then the fixing solution was sprayed uniformly on the cloth, (2) the cloth was dipped with the face of toner images upwards for about 1 second in a tray filled with the fixing solution up to 5 mm depth.

After treated with the fixing solution, the cloth was dried. The cloth had tendency to shrink by sudden high-temperature heat. In order to prevent the cloth from such shrinking, the cloth wetted with the solvent was left on filter paper for about 20 minutes. After the filter paper sucked the solvent, the cloth was placed on a metal plate covered with cloth to be heated (about 100° C.), so that the solvent was evaporated completely.

After dried, the cloth was washed with hands in an aqueous solution containing 0.5% of sodium dodecyl sulfate as a surface active agent. Discoloration of the clothes A, B and C was not recognized.

The coloring of each cloth was compared. The cloth B made of polyester series was best. The reason is not necessarily clear, but probably because the fixing solution contains an ester component which is also contained in the binder resin for toner.

EXAMPLE 2

A copying machine for full color available in the market (trade name of CF80, made by Minolta Camera K.K.) was remodeled so that a roller unit for fixing by heat and pressure was taken away. In the remodeled copying machine, toner images formed on a photosensitive member were electrostatically transferred to plain paper by a corona-charger of a noncontact type. The plain paper could be taken out from the copying machine without no further treatment. In this example, a roller-type charger of a contact type may be used in the electrostatically transferring process.

Full-color toner images were formed on plain paper of A4 size with the same toner as in Example 1 by use of the above remodeled copying machine. The toner images were merely electrostatically supported to the plain paper.

The toner images supported to the plain paper were electrostatically transferred to cloth D (raising type of polyester, length of about 2 mm) by use of a machine shown in FIG. 1 as described as follows. The plain paper 3 to which toner images were supported was contacted firmly with the cloth D. The plain paper 3 and the cloth D were set between electrodes 1 and 2. A voltage of +1.5 KV was applied between the two electrodes through an electrical source 4 to transfer the toner images electrostatically from the plain paper to the cloth D.

Then the cloth D with the toner images transferred thereon was put on a metal plate heated to about 100° C. with the surface of toner images upwards. The cloth was heated on the plate for 1 minute so that the toner images would adhere thermally to the cloth. Successively the cloth D was dipped in the same fixing solution as in the Example 1 and then dried naturally to fix the toner images.

Figure 2:
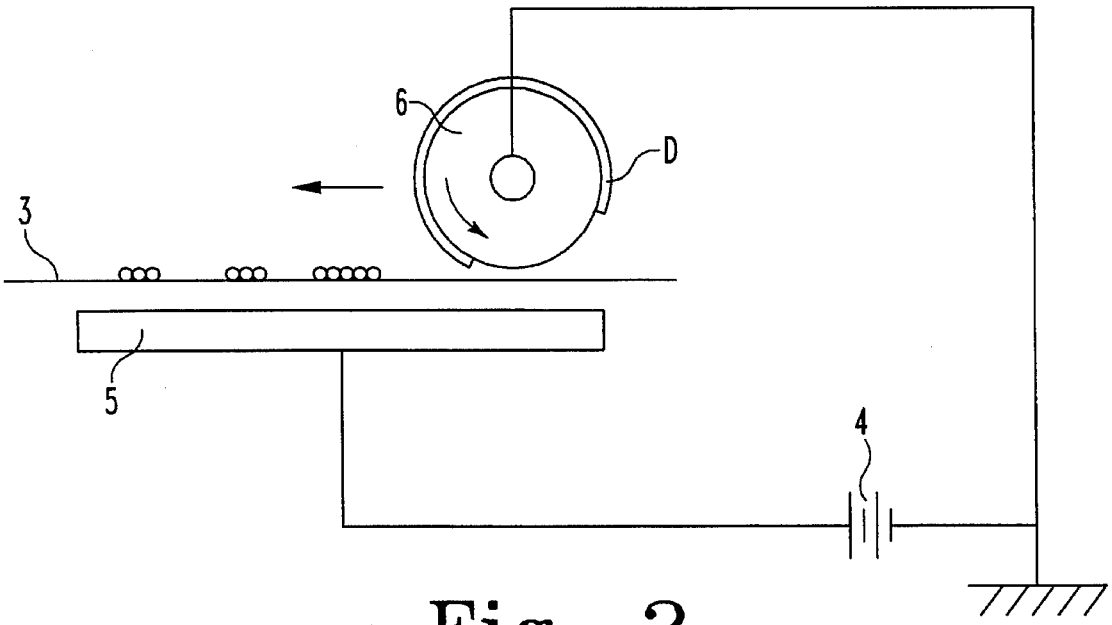
FIG. 2 is another schematic view of an apparatus for transferring toner images on a recording member.

In this example, a machine shown in FIG. 2 may be used to transfer electrostatically toner images to the cloth D. In this machine, an electrically conductive roller 6 connected to an electrically source 4 is revolved in the direction of the arrow shown in the figure over the plain paper 3 which has supporting toner-images and is placed on an electrode 5.

The resultant cloth D was washed with hands in the aqueous solution containing the surface active agent in a manner similar to Example 1. Discoloration of the cloth D was almost not recognized.

In the above method, as an extra pressure is not applied to toner images, toner images can be fixed three-dimensionally on a cloth, such as a pile fabric having raising, loops and other irregularities thereon, without breaking those irregularities.

In general, a temperature between 50° and 150° C., preferably 60° and 120° C., more preferably 70° and 100° C. is applied to the metal plate. A temperature applied to the metal plate is, however, not particularly limited insofar as toner images are not indisarranged when fixed finally with a fixing solution.

EXAMPLE 3

A copying machine for full color available in the market (trade name of CF80, made by Minolta Camera K.K.) was remodeled so that a heater component in a roller unit for fixing by heat and pressure was taken away. The fixing roller unit was remodeled to stick toner images stronger on plain paper at a certain pressure without heat.

The fixing roller was set at a temperature of room temperature and a pressure of 1.0Kgf/cm$^2$.

A recording medium used in this Example was a cloth (E: Nylon) weak in temperature. The cloth was stuck to a card board (plain paper) in a manner similar to Example 1. The cloth on the card board was passed through the remodeled copying machine.

The resultant cloth D with toner images was dipped in the same fixing solution as in Example 1. Then the cloth was dried naturally to fix the toner images. The obtained cloth was washed with hands in the aqueous solution containing the surface active agent in a manner similar to Example 1. Discoloration was not recognized.

In such a fixing process as above mentioned, toner images can be fixed even on a cloth weak in temperature. Further the toner images can be fixed very strongly.

In general, a pressure between 0.2 and 3Kgf/cm$^2$, preferably 0.4 and 2.5Kgf/cm$^2$, more preferably 0.8 and 2.0Kgf/cm$^2$ is applied. A pressure applied to toner images is not particularly limited insofar as the toner images are not indisarranged when fixed finally with a fixing solution.

EXAMPLE 4

The remodeled copying machine CF80 (with the fixing unit by heat and pressure removed) used in Example 2 was used. Full-color toner images were transferred to a cloth F (made of flannel) set on a cardboard in a manner similar to Example 1.

Then the cloth with toner images transferred thereon was dipped in the same fixing solution as in Example 1. The cloth was dried naturally to fix the toner images. Although the resultant cloth was washed in the aqueous solution containing the surface active agent in a manner similar to Example 1, discoloration was not recognized.

In such a fixing process as above mentioned, neither heat nor pressure is not needed when toner images are adhered to a recording member. As the contact of the cloth with a fixing process is carried out by a mere dipping treatment, the present invention makes it possible to fix toner images by an energy-saving method.

Comparative Example

Toner images were fixed on the same cloth A as used in Example 1 by means of a full-color copying machine (trade name: CF80, made by Minolta Camera K.K.).

The resultant cloth was not contacted with a fixing solution. The cloth was washed with hands in the aqueous solution containing the surface active agent in a manner similar to Example 1. Discoloration was recognized after washing.

What is claimed is:

1. A method for fixing images formed by a printing material containing a resin component on a recording medium, comprising:

a first step of providing the printing material to the recording medium to form the images, and a second step of contacting the printing material provided on the recording medium with a fixing solution containing at least a monoester of bivalent organic acid to fix the printing material on the recording medium.

2. The method of claim 1, in which the printing material is a toner comprising a binder resin and a colorant.

3. The method of claim 2, in which the first step comprises:

a step of developing electrostatic latent images formed on an electrostatic latent image-supporting member with the toner and a step of transferring the toner images formed on the electrostatic latent image-supporting member on the recording member.

4. The method of claim 1, in which the first step comprises a step of forming multi-color images on the recording member with at least two kinds of toners selected from a yellow toner, a cyan toner, a magenta toner and a black toner by means of a multi-color electrophotographic method.

5. The method of claim 4, in which in the first step, the multi-color images are formed on the recording member supported on an intermediate transferring member arranged oppositely to the electrostatic latent image-supporting member.

6. The method of claim 4, in which the first step comprises:

a step of forming the multi-color images on an intermediate transferring member arranged oppositely to the electrostatic latent image-supporting member and a step of transferring the multi-color images formed on the intermediate transferring member on the recording member.

7. The method of claim 4, in which the first step comprises:

a step of forming the multi-color images on an intermediate transferring member arranged oppositely to the electrostatic latent image-supporting member, a step of transferring the multi-color images formed on the intermediate transferring member on plain paper and a step of transferring the multi-color images formed on the plain paper on the recording member.

8. The method of claim 4, in which the first step further comprises a step of heating the multi-color images formed on the recording medium.

9. The method of claim 4, in which the first step further comprises a step of applying pressure to the multi-color images formed on the recording medium by a pressure fixing device.

10. The method of claim 1, in which the images are formed on the recording medium by a ink-jetting method in the first step.

11. The method of claim 1, in which the monoester of bivalent organic acid is represented by the following formula:

$$HOOC—(CH_2)_n—COOR_1$$

in which $R_1$ represents an alkyl group having 1 to 5 carbon atoms and the letter "n" represents an integer of 0 to 8.

12. A method for fixing images formed by a toner containing a binder resin and a colorant on a recording medium, comprising:

a first step of forming multi-color images on the recording member with at least two kinds of toners selected from a yellow toner, a cyan toner, a magenta toner and a black toner by means of a multi-color electrophotographic method and a second step of contacting the multi-color images formed on the recording member with a fixing solution containing at least a monoester of bivalent organic acid to fix the multi-color images on the recording medium.

13. The method of claim 12, in which in the first step, the multi-color images are formed on the recording member supported on an intermediate transferring member arranged oppositely to an electrostatic latent image-supporting member.

14. The method of claim 12, in which the first step comprises:

a step of forming the multi-color images on an intermediate transferring member arranged oppositely to an electrostatic latent image-supporting member and a step of transferring the multi-color images formed on the intermediate transferring member on the recording member.

15. The method of claim 12, in which the first step comprises:

a step of forming the multi-color images on an intermediate transferring member arranged oppositely to an electrostatic latent image-supporting member, a step of transferring the multi-color images formed on the intermediate transferring member on plain paper and a step of transferring the multi-color images formed on the plain paper on the recording member.

* * * * *